US005958833A

United States Patent [19]

Chujo et al.

[11] Patent Number: 5,958,833

[45] Date of Patent: Sep. 28, 1999

[54] THERMAL TRANSFER SHEET AND METHOD FOR MANUFACTURING SAME

[75] Inventors: Shigeki Chujo; Junichi Hiroi; Nobuyuki Harada, all of Shinjuku-ku, Japan

[73] Assignee: Dai Nippon Printing Co., Ltd., Tokyo-to, Japan

[21] Appl. No.: 09/007,567

[22] Filed: Jan. 15, 1998

[30] Foreign Application Priority Data

Jan. 17, 1997 [JP] Japan ..... 9-017705

[51] Int. Cl.[6] ..... B41M 5/035; B41M 5/38

[52] U.S. Cl. ..... 503/227; 427/152; 428/195; 428/423.1; 428/447; 428/488.4; 428/913; 428/914

[58] Field of Search ..... 8/471; 427/146, 427/152; 428/195, 484, 488.1, 488.4, 447, 423.1, 913, 914; 503/227

[56] References Cited

U.S. PATENT DOCUMENTS 5,134,034 7/1992 Makishima et al. ..... 428/412

FOREIGN PATENT DOCUMENTS 62-284784 12/1987 Japan ..... B41M 5/26
1-30787 2/1989 Japan ..... 503/227

OTHER PUBLICATIONS

Research Disclosure "Dye–Donor Elements and Dye–Receiving Elements for Thermal Transfer", No. 353, Sep. 1, 1993, pp. 615–627, United Kingdom.

*Primary Examiner*—Bruce H. Hess
*Attorney, Agent, or Firm*—Ladas & Parry

[57] ABSTRACT

A thermal transfer sheet of the present invention has a heat resistant layer disposed on a back surface thereof and a slip layer disposed on the heat resistant layer. The heat resistant layer contains a binder resin having a molecular structure, one end portion of which is an end group selected from the group consisting of hydroxyl, amino, carboxyl and mercapto. The slip layer contains silylisocyanate represented by the following formula (1): $R_n$—Si—(N C O)$_{4-n}$ [in the formula (1), R denotes alkyl, aryl or vinyl; and "n" denotes an integer of 0 to 3]. The slip layer is hardened by reacting an isocyanate group of the silylisocyanate contained therein with the end group of the binder resin contained in the heat resistant layer.

14 Claims, 1 Drawing Sheet

THERMAL TRANSFER SHEET AND METHOD FOR MANUFACTURING SAME

BACKGROUND OF THE INVENTION

1. Field of the Invention

The present invention relates to a thermal transfer sheet, and particularly relates to a thermal transfer sheet comprising a heat resistant layer and a slip layer provided on its back surface, which is excellent at response to a heated thermal head such as slipping property or releasability, capable of preventing formation of a head grime in a heating operation by the thermal head and a cooling process thereafter, and also preventing crumples of the thermal transfer sheet or an image-receiving material in a printing process, thereby providing an printed image with high quality. The present invention further relates a method for manufacturing such a thermal transfer sheet.

2. Description of the Related Art

As conventional thermal transfer sheets, there have been known a sublimation type thermal transfer sheet and a heat fusion type thermal transfer sheet. A typical sublimation thermal transfer sheet is composed of a substrate film made of plastic such as polyester and a dye layer as a thermally transferable coloring material layer which is disposed on one surface of the substrate film and made of sublimation dye and binder resin. On the other hand, the heat fusion thermal transfer sheet has a heat fusible ink layer made of a heat fusible composition containing coloring material instead of the dye layer. Such a thermal transfer sheet is image-wise heated from its back surface side by a heating means such as the thermal head to transfer the dye of the dye layer or the heat fusible composition of the heat fusible ink layer to the image-receiving material, thus forming an image.

Use of the conventional thermal transfer sheet having a substrate film made of relatively heat fusible material such as plastic has caused problem in a process for formation of the image, such as deterioration of the releasability and the slipping property to the thermal head and breakage of the substrate film. In order to solve that problem, a heat resistant ship layer has been formed on a surface of the substrate film opposite to the surface on which the coloring material layer is disposed by using modified resin such as thermosetting resin and silicone resin solely or in combination with cross linking agent. However, along with improvements in printing speed and printing quality of a printer, there has been desired a more excellent heat resistance and slipping property of the heat resistant slip layer, and has also been desired to reduce estrangement of the slipping property effected at a printing time from that demonstrated in an non-printing time. Accordingly, there has been made an attempt to add a lubricant such as surface active agent, oil, organometallic salt and wax any one of which has the good slipping property and the good releasability in a heated condition into the heat resistant slip layer.

At the time of image formation, printing energy to be applied to the thermal transfer sheet by the thermal head is varied in a wide range according to respective printing densities, and the slipping property and the releasability are desired to be stable within the whole range of the printing energy. However, the conventional lubricant has still caused problem.

More specifically, in a case where the lubricant to be added is liquid, it may have a poor compatibility to the binder resin for the heat resistant slip layer. Furthermore, the liquid lubricant may transfer to undesirable place. Firstly, when the liquid lubricant has a low viscosity, the lubricant may transfer to the opposite surface of the substrate film or a surface of a conveying roll in the manufacturing or working process to cause a shortage of the lubricant in the heat resistant slip layer of the thermal transfer sheet as an end product. Accordingly, the use of the liquid lubricant may cause a deterioration of the slipping property. Second, when the thermal transfer sheet is rolled up, the use of the liquid lubricant may cause the transferring of the coloring material from the coloring material layer to the adjacent heat resistant slip layer, resulting in contamination of the heat resistant slip layer. Third, when an intermediate product of the thermal transfer sheet which has the heat resistant slip layer but no coloring material layer is rolled up, the liquid lubricant may transfer from the heat resistant slip layer to an exposed front surface of the adjacent substrate film, thereby causing deterioration of wettability of the substrate film to a coating solution for the coloring material layer.

On the other hand, in another case where the lubricant to be added is solid or wax, the slipping property and the releasability may be insufficient because of its slow response to a momentary heating, and further, the lubricant may be deposited on the surface of the thermal element such as the thermal head to become the head grime in a cooling process after the heating with the use of the thermal head, thus causing a bad influence to the printed surface. As shown in FIG. 2, when the thermal head 8 is sliding along the back surface 7 of a conventional thermal transfer sheet 101, the head grime 10 is liable to be deposited on a surface of an advance direction (9) side of the thermal head 8.

In another problem of the conventional thermal transfer sheet, when each printing line of the thermal transfer sheet which is a portion to come contact simultaneously with the heating means such as the thermal head includes printed portions to be heated by the heating means and non printed portion not to be heated, the slipping property of the heat resistant slip layer to the heating means, i.e. a friction coefficient, varies in accordance with heat energy applied from the heating means, and may be involved in un-uniform in dependence on the portions to cause crumples of the thermal transfer sheet, resulting in the dropping out of print.

SUMMARY OF THE INVENTION

Accordingly, an object of the present invention is to provide a thermal transfer sheet which is excellent at response to a heated thermal head such as slipping property or releasability, capable of preventing formation of a head grime in a heating operation by the thermal head and a cooling process thereafter, and also preventing crumples of the thermal transfer sheet or an image-receiving material in a printing process, and further capable of transferring no lubricant from a back surface of the thermal transfer sheet to undesirable places such as a front surface of another thermal transfer sheet adjacent thereto, thereby providing an printed image with high quality. Another object of the present invention is to provide a method for manufacturing the above thermal transfer sheet.

A thermal transfer sheet provided by the present invention comprises a substrate film, a transferable layer which is disposed on one surface of the substrate film, and a heat resistant layer and a slip layer both of which are disposed on another surface of the substrate film with said heat resistant layer and said slip layer being close to the substrate film in this order, wherein:

the heat resistant layer contains a binder resin having a molecular structure, one end portion of which is an end group selected from the group consisting of hydroxyl group, amino group, carboxyl group and mercapto group; and the slip layer contains silylisocyanate represented by the following formula (1):

$$R_n—Si—(NCO)_{4-n} \quad \text{FORMULA (1)}$$

[in the formula (1), R denotes alkyl group, aryl group or vinyl group; and "n" denotes an integer of 0 to 3].

In the thermal transfer sheet defined as described above, the slip layer is hardened by reacting an isocyanate group of the silylisocyanate contained in the slip layer with the above end group of the binder resin contained in the heat resistant layer. It is preferable that the heat resistant layer further contains a lubricant, especially a lubricant being liquid state at a room temperature. It is also preferable that the heat resistant layer further contains an organic filler or an inorganic filler, especially at least one inorganic filler selected from the group consisting of talc, kaolin and clay. A preferable applied amount of the heat resistant layer is not more than 5.0 g/m$^2$ in a solid component, and a preferable applied amount of the slip layer is in a range of 0.1 to 1.0 g/m$^2$ in a solid component. A primer layer is preferably disposed between the substrate sheet and the heat resistant layer. The transferable layer to be disposed on a front surface side of the thermal transfer sheet may be a coloring material layer selected from the group consisting of a sublimation dye layer and a heat fusible ink layer.

A manufacturing method provided by the present invention is to manufacture such a thermal transfer sheet, which comprises steps of:

applying a coating material for the heat resistant layer containing a binder resin having a molecular structure, one end portion of which is an end group selected from the group consisting of hydroxyl group, amino group, carboxyl group and mercapto group on the substrate film, and solidifying the same to form the heat resistant layer;

applying a coating material for the slip layer containing silylisocyanate represented by the following formula (1) on the heat resistant layer, $$R_n—Si—(NCO)_{4-n} \quad \text{FORMULA (1)}$$

[in the formula (1), R denotes alkyl group, aryl group or vinyl group; and "n" denotes an integer of 0 to 3]

to form a raw slip layer; and, solidifying said raw slip layer while reacting an isocyanate group of the silylisocyanate contained in the raw slip layer with said end group of the binder resin contained in the heat resistant layer, to form the slip layer.

In the manufacturing method defined as described above, the transferable layer to be disposed on the front surface of the substrate film can be formed at any stage throughout the course of manufacture.

The coating material for the heat resistant layer may be a coating liquid prepared by dissolving or dispersing the binder resin having a molecular structure, one end portion of which is an end group selected from the group consisting of hydroxyl group, amino group, carboxyl group and mercapto group in a solvent. When such a coating liquid for the heat resistant layer is applied on the substrate film, a raw heat resistant layer thus formed can be solidified by drying.

The coating material for the heat resistant layer may be a coating liquid containing the binder resin having a molecular structure, one end portion of which is an end group selected from the group consisting of hydroxyl group, amino group, carboxyl group and mercapto group, and a hardening substance. When such a coating liquid for the heat resistant layer is applied on the substrate film, a raw heat resistant layer thus formed can be solidified by hardening reaction of the hardening substance.

On the other hand, the coating material for the slip layer may be a coating liquid prepared by dissolving or dispersing the silylisocyanate in a solvent. When such a coating liquid for the slip layer is applied on the heat resistant layer, a raw slip layer thus formed can be solidified by drying.

In the present invention, for the purpose of improving heat resistance and slipping property of the heat resistant slip layer so as to comply with improvements in printing speed and printing quality of a printer, and for the purpose of reducing estrangement of the slipping property of the heat resistant slip layer between a printing time and an non-printing time or between a heated portion and a non-heated portion so as to prevent crumples of the thermal transfer sheet and dropping out of print owing to that crumples, the heat resistant slip layer is separated into two functionally different layers, one of which is a heat resistant layer disposed on the back surface of the substrate film and mainly providing heat resistant effect, and another one of which is a slip layer disposed on the heat resistant layer and mainly providing slipping effect.

In the prior art, a lubricant such as surface active agent, oil or the like has been applied on the back surface of the thermal transfer sheet, because it has a good response to a momentary heating and a little estrangement of the slipping property between a printing time and an non-printing time. However, such a lubricant applied on the back surface of the thermal transfer sheet is reliable to transfer to another portion, such as a coloring material layer of another thermal transfer sheet laid on the former thermal transfer sheet.

In the present invention to the contrary, because the silylisocyanate represented by the formula (1) as the lubricant is added into the slip layer with the binder resin in which an end group of one end of the molecular structure is hydroxyl group, amino group, carboxyl group or mercapto group added into the heat resistant layer, the slip layer is hardened and fixed on the heat resistant layer by the reaction of the isocyanate group with the above described end group, thereby preventing migration of the lubricant as well as maintaining a good slipping property of the slip layer.

Though the silylisocyanate represented by the formula (1) can provide a good slipping property for the slip layer, it is liable to be hardened very well by the reaction with another chemical substance having a functional group. Therefore, if a coating material for a heat resistant slip layer is prepared by mixing the above silylisocyanate with the heat resistant, binder resin, it is difficult to apply the thus prepared coating material on the substrate film because it is hardened even in a coating step. Thus, in the present invention, the slip layer containing the silylisocyanate represented by the formula (1) but no resin hardenable therewith is formed separately from the heat resistant layer.

DESCRIPTION OF THE PREFERRED EMBODIMENT

Figure 1:
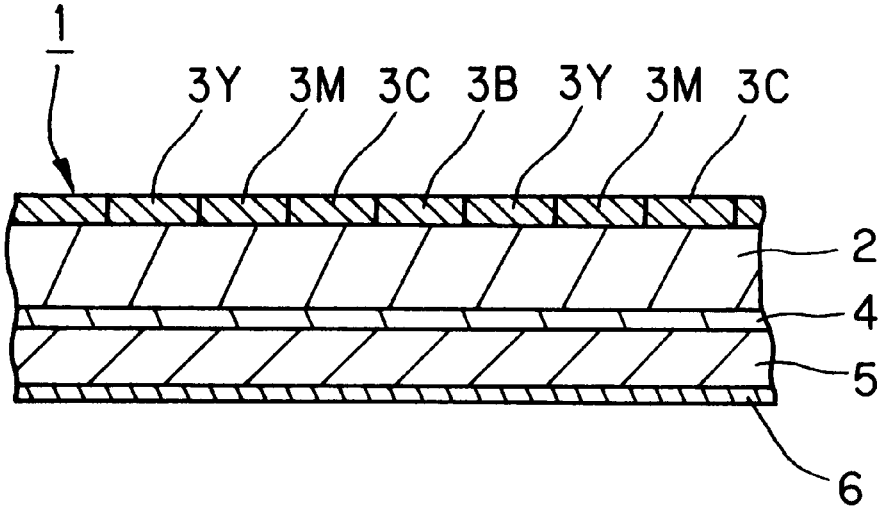
FIG. 1 is a schematic sectional view of one example of a thermal transfer sheet according to the present invention; and, FIG. 2 is an explanatory view indicating a formation process of a head grime.
Figure 2:
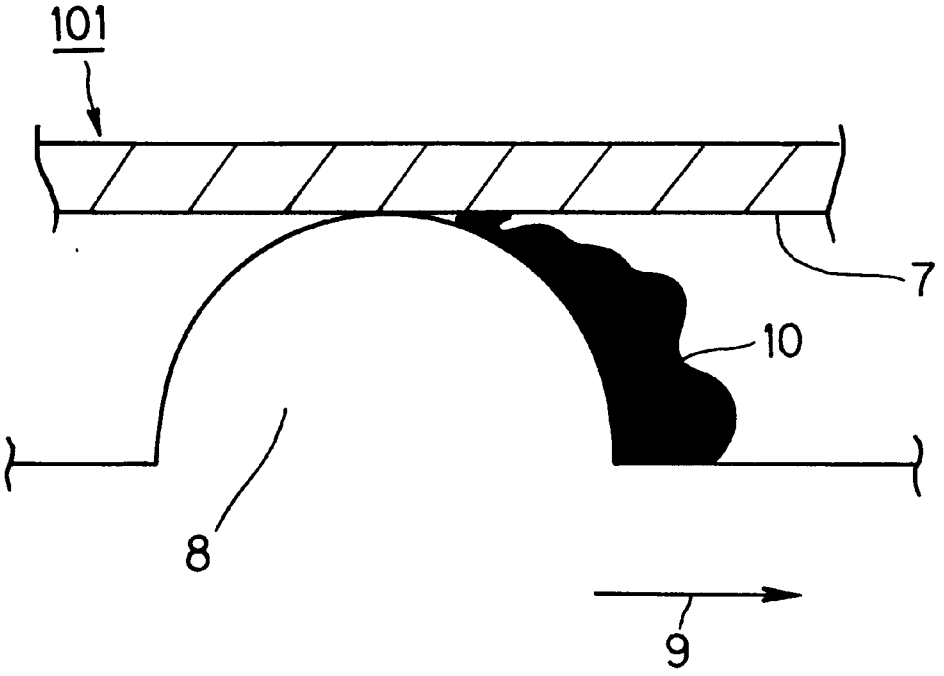
FIG. 2 PRIOR ART

The present invention will be described further in detail hereunder with reference to a preferred exemplary embodiment thereof. FIG. 1 shows a schematic sectional view of one example of the thermal transfer sheet according to the present invention. In FIG. 1, the thermal transfer sheet 1 has a substrate film 2, and plural kinds of transferable layers, i.e., sublimation dye layers of Yellow (3Y), Magenta (3M), Cyan (3C) and Black (3B) are formed on a front surface of the substrate film 2 side by side in this order. Furthermore, a primer layer 4, a heat resistant layer 5 and a slip layer 6 are formed on a back surface of the substrate film 2 in this order from a position close to the back surface.

The thermal transfer sheet of the present invention essentially provided with (i) one or more kinds of transferable layer which are optionally selected and laid on the front surface side of the substrate film side by side, (ii) the heat resistant layer which contains a binder resin having hydroxyl group, amino group, carboxyl group or mercapto group at one end of its molecular structure and lies on the back surface side of the substrate film, and (iii) the slip layer which contains silylisocyanate represented by the following formula (1) and lies on the heat resistant layer.

$$R_n—Si—(NCO)_{4-n} \qquad \text{FORMULA (1)}$$

[in the formula (1), R denotes alkyl group, aryl group or vinyl group; and "n" denotes an integer of 0 to 3].

The transferable layer to be disposed on the front surface side may be thermally transferable itself or contain a thermally transferable component. The transferable layer capable of transferring itself includes a heat fusible ink layer, a transferable receptor layer, a transferable protect layer or the like. The transferable layer enabling the component therein to transfer includes the sublimation dye layer described above.

Detailed explanation for the substrate film and the layers to be often formed on the substrate film will be described hereunder.

[SUBSTRATE FILM]

In the present invention, the substrate film for the thermal transfer sheet is not limited to a specific one as far as the film has a desired heat resistance and strength, and a known substrate film conventionally used for a general thermal transfer sheet may be used. An example for the substrate film includes the following films which usually have a thickness of 0.5 to 50 $\mu$m, and preferably 3 to 10 $\mu$m: a resin film such as polyethylene terephthalate film, poly 1,4-cyclohexylenedimethylene terephthalate film, polyethylene naphthalate film, polyphenylene sulfide film, polystyrene film, polypropylene film, polysulfone film, aramid film, polycarbonate film, polyvinylalcohol film, cellophane, a film of cellulose acetate or another cellulose derivative, polyethylene film, polyvinylchloride film, nylon film, polyimide film and ionomer film; a paper such as condenser paper and paraffin paper; a non woven fabric; and a composite film composed of these films such is the resin film and the paper and the non woven fabric.

[HEAT RESISTANT LAYER]

The heat resistant layer on one surface of the substrate film is formed of at least the binder resin having a molecular structure, one end portion of which is hydroxyl group, amino group, carboxyl group or mercapto group, and it may contain various kind of additives such as filler, lubricant or the like as the occasion demands.

The binder resin for the heat resistant layer is not limited to a specific one as far as it has hydroxyl group, amino group, carboxyl group or mercapto group at one end of its molecular structure, and any one of thermoplastic resin and thermosetting resin may be used solely or in combination with each other as the binder resin. A reaction product obtained by reacting the above binder resin having hydroxyl group or the like with a hardening agent such as an isocyanate hardening agent, a monomer or oligomer containing unsaturated bond may also be used as the binder resin having an improved heat resistance. A method for the hardening is not limited to a specific one, and the reaction product may be hardened by, for example, the heating or the ionizing radiation. Furthermore, each kind of modified resin obtained by modifying the binder resin with silicone, long chain alkyl or the like may be used as the binder resin for the heat resistant layer.

As the binder resin having hydroxyl group, amino group, carboxyl group or mercapto group at one end of its molecular structure, there may preferably be used, for example, polyester resins, polyacrylic ester resins, polyvinylacetate resins, styrene acrylate resins, polyurethane resins, polyolefine resins, polystyrene resins, polyvinylchloride resins, polyether resins, polyamide resins, polycarbonate resins, polyethylene resins polypropylene resins, polyacrylate resins, polyacrylamide resins, polyvinyl butyral resins, and polyvinyl acetoacetal resins, and more preferably used polyacetal resins such as polyvinyl acetoacetal resins. As the modified resin, there may be used various kinds of the silicone modified resins supplied on the market, and a reaction product obtained by reacting a resin having hydroxyl group such as acrylic polyol or acetal resin with monohydric higher alcohol derivative modified with isocyanate.

For the purpose of improving the thermal transfer sheet in workability, conveyance stability in a printer and cleaning property to the thermal head, an organic or inorganic filler may be added in the heat resistant layer. The filler for the heat resistant layer has a particle size and a shape to provide a properly uneven surface to the slip layer, and does not wear the thermal head so much. As the filler, there may be exemplified: inorganic filler such as talc, kaolin, clay, calcium carbonate, magnesium hydroxide, magnesium carbonate, magnesium oxide, precipitated barium sulfate, hydrotalcite silica or the like;, and organic filler such as acrylic resin, benzoguanamine resin, silicone, polyfluoroethylene fiber or the like. A preferable filler is such one having cleavablility, a relatively low hardness and cleaning property to the thermal head as talk, kaolin or clay. A preferable talc has an abrasion effect in a range of 15 to 200 mg in terms of the shot-type abrasion loss test, in which the abrasion loss is detected by adding slugs made of lead into water together with a prescribed amount of the sample talc, agitating same in a prescribed time of period, and then subtracting a weight of the slugs measured after the agitation from an initial weight thereof measured before agitation. When the filler has an excessively small abrasion effect, the head grim is liable to be formed. On the other hand, an excessively large abrasion effect of the filler accelerates the wear or the abrasion of the protect layer of the thermal head.

A lubricant may be added in the heat resistant layer in order to further improve and stabilize the property of the thermal transfer sheet. Because the thermal transfer sheet of the present has a relatively thin slip layer as described later, it is probable that the heat resistant layer is partially exposed from underneath of the slip layer. Thus the lubricant in the heat resistant layer can compensate lack of slipping property at a portion missing the slip layer. As the lubricant for the heat resistant layer, there may be used: for example, waxes such as polyethylene wax or paraffin wax; higher aliphatic alcohol; organopolysiloxane; anionic surface active agent; cationic surface active agent; ampho-ionic surface active agent; nonionic surface active agent; fluorine surface active agent; organocarboxylic acid or derivatives thereof; and a long chain-aliphatic compound. A preferable lubricant is such one being in a liquid state at a room temperature as a phosphoric ester series surface active agent or the like. When the lubricant being in a liquid state at a room temperature is added in the heat resistant layer, that lubricant sufficiently responds to a momentary heating in a printing process, thereby reducing an estrangement of the slipping property between a printing time and a non printing time even at a portion missing the slip layer.

In one method, the heat resistant layer may be formed by: previously selecting proper solvent among a organic solvent such as acetone, methyl ethyl ketone, toluene, xylene or the like and water in order to control the coating suitability; dissolving or dispersing the raw material as described above in the selected solvent to prepare a coating liquid; applying the coating liquid on the back surface side of the substrate film through the known coating method or means such as a gravure coater, a roll coater, a wire coater or the like; and then drying and solidifying it. An applied amount of the coating liquid, i.e., a thickness of the heat resistant layer is usually up to 5.0 g/m$^2$, and preferably in a range of 0.1 to 2.0 g/m$^2$ based on a content of a solid component, and the heat resistant layer having a sufficient property can be formed within such an amount. In a case where optional additives such as the filler or the lubricant are used together, an addition amount of each additive is usually in a range of 1 to 150 weight parts, preferably 40 to 120 weight parts to 100 weight parts of the binder resin for the heat resistant layer.

[SLIP LAYER]

The slip layer is formed on the heat resistant layer which is formed on the back surface of the substrate film, and it contains at least silylisocyanate represented by the following formula (1):

$$R_n—Si—(NCO)_{4-n} \qquad \text{FORMULA (1)}$$

[in the formula (1), R denotes alkyl group, aryl group or vinyl group; and "n" denotes an integer of 0 to 3].

The above silylisocyanate functions as a lubricant. Use of the silylisocyanate represented by the formula (1) improves productivity, because it has enough reaction speed and enough reactivity at a relatively low temperature to omit an aging process. Furthermore, the slip layer containing the above silylisocyanate can be hardened and fixed on the heat resistant layer by reacting isocyanate groups of the silylisocyanate of the slip layer with the end groups included in the binder resin of the heat resistant layer such as hydroxyl group, amino group, carboxyl group or mercapto group, thereby preventing migration of the silylisocyanate as well as maintaining a good slip property of the slip layer.

Any additive such as the filler and the lubricant other than the silylisocyanate represented by the formula (1) used for the heat resistant layer may be added in the slip layer as far as it does not react with the silylisocyanate In one method, the slip layer may be formed by: previously selecting proper solvent among organic solvent such as acetone, ethyl acetate, methyl ethyl ketone, toluene, xylene or the like and water in order to control the coating suitability; dissolving or dispersing the raw material as described above in the selected solvent to prepare a coating liquid; applying the coating liquid on the heat resistant layer through the known coating method or means such as a gravure coater, a roll coater and a wire coater; and then drying and solidifying it. An applied amount of the coating liquid, i.e., a thickness of the slip layer is preferably in a range of 0.1 to 1.0 g/m$^2$ based on a content of a solid component.

[COLORING MATERIAL LAYER]

A thermal transferable coloring material layer may be formed on the front surface of the substrate film. In a case of the sublimation thermal transfer sheet, a dye layer containing sublimation dye is formed on the substrate film, and in a case of the heat fusion type thermal transfer sheet, a heat fusible ink layer colored with pigment or the like is formed thereon. The sublimation thermal transfer sheet will intensively be described hereunder. Though detail of another coloring material layer is omitted, the coloring material layer is not limited to only the sublimation type dye layer.

A dye for the sublimation type dye layer is not limited to a specific one, and a dye conventionally used for the known thermal transfer sheet may be used in the present invention. For example: a preferable red dye includes MS Red G, Macrolex Red Violet R, Ceres Red 7B, Samaron Red HBSL and Resolin Red F3BS; and a yellow dye includes Phorone Brilliant Yellow 6GL, PTY-52 and Macrolex Yellow 6G; and a preferable blue dyes includes Kayaset Blue 714, Waxoline Blue AP-FW, Phorone Brilliant Blue S-R and MS Blue 100.

For a binder resin to carry and sustain the dye, any kind of known binder resin can be used. A preferable binder resin includes: for example, cellulose resins such as ethyl cellulose, hydroxyethyl cellulose, ethyl hydroxycellulose, hydroxypropyl cellulose, methyl cellulose, cellulose acetate and cellulose acetate butyrate; vinyl resins such as polyvinyl alcohol, polyvinyl acetate, polyvinyl butyral, polyvinyl acetoacetal and polyvinyl pyrrolidone; acrylic resins such as poly(metha)acrylate and poly(metha)acrylamide; polyurethane resins; polyamide resins; and polyester resins. Of these binder resins, there may preferably be used the cellulose series, vinyl series, acrylic series, polyurethane series and polyester series resins in view of heat resistance, transability of the dye or the like.

The dye layer may be formed on one surface of the substrate film by the following manner. That is, a mixture of the dye, the resin binder and an optionally added additive such as release agent, organic or inorganic particle are dissolved in a proper organic solvent such as toluene, methyl ethyl ketone, ethanol, isopropyl alcohol, cyclohexanone or DMF, or dispersed in the above organic solvent or water to prepare a coating liquid, and the thus prepared coating liquid is applied on the substrate film and dried through any coating method such as a gravure printing, a screen printing and a reverse roll coating with the use of a gravure plate.

An applied amount of the dye layer is usually in a range of 0.2 to 5.0 g/m$^2$, and preferably 0.4 to 2.0 g/m$^2$, based on a content of a solid component. Besides, an amount ratio of the sublimation dye in the dye layer is usually in a range of 5 to 90 weight %, and preferably 10 to 70 weight %, with respect to a weight of the dye layer.

In a case where a monochromatic image is to be printed, one kind of the dye layer may be formed by selecting only one proper dye. On the other hand, in a case where an image is to be printed in various colors, at least two kinds of the dye layers should be formed in a combination of, for example, Yellow, Magenta and Cyan, or further with Black by selecting respective proper dyes.

[PRIMER LAYER]

Adhesiveness between the substrate film and the heat resistant layer can be improved by forming a primer layer between them. The primer layer is desired to have a sufficient adhesion property to the substrate film and the heat resistant layer, and a sufficient heat resistance and a sufficient dimensional stability so as to prevent a thermal deformation of the substrate film. The primer layer may be formed of any one of thermoplastic resin, thermosetting resin, a mixture of a hardening agent and a resin having reaction group which is reactive with the hardening agent, and a coating composition capable of the cross linking reaction by the irradiation of the light or the ionizing radiation. A coating amount of the primer layer is usually up to 1.0 g/m$^2$, and preferably in a range of 0.1 to 0.5 g/m$^2$, based on the content of the solid component.

Even if the primer layer is formed, the adhesiveness between the substrate film and the heat resistant layer can be improved by subjecting the surface of the substrate film directly to a treatment for improving adhesion, a corona discharge treatment or the like.

[MANUFACTURE OF THERMAL TRANSFER SHEET]

In one method, the thermal transfer sheet of the present invention is formed by the following manner. That is, a coating liquid containing at least the binder resin having hydroxyl group, amino group, carboxyl group or mercapto group at one end portion of its molecular structure is applied on the back surface of the substrate film, and dried to solidify the heat resistant layer. Thereafter, a coating liquid containing at least silylisocyanate represented by the formula (1) is applied on the heat resistant layer to form a raw slip layer. Then the raw slip layer is dried while reacting an isocyanate group of the silylisocyanate contained in the raw slip layer with the end group of the binder resin contained in the heat resistant layer, to solidify the raw slip layer. The transferable layer such as dye layer may be formed before or after formation of the heat resistant layer.

A reaction product obtained by reacting the above binder resin having hydroxyl group or the like with a hardening agent such as an isocyanate hardening agent, a monomer or oligomer containing unsaturated bond may also be used as the binder resin having an improved heat resistance. The heat resistant layer containing the above reaction product as binder resin is formed by applying a coating liquid containing the resin having hydroxyl group, amino group, carboxyl group or mercapto group at one end portion of its molecular structure and the hardening agent onto the substrate film, and solidifying the thus applied coating liquid through a hardening process. The hardening process may be carried out by any known method such as heating, irradiation of ionizing radiation or the like. When the heat resistant layer is hardened by heating, a composition of the coating liquid for the heat resistant layer is regulated so as to reduce its hardening speed for attaining storage stability of the coating liquid. In such a case, the heat resistant layer can be hardened well by heat aging after the slip layer is formed on the heat resistant layer.

[IMAGE RECEIVING SHEET]

The image receiving material to be used together with the thermal transfer sheet of the present invention is not limited to a specific one. In a case of the sublimation transfer, there may be used any image receiving material as far as its record surface is receptive to the above dye, and furthermore, though the receiving material is formed of non-receptive material such as paper, metal, glass and synthetic resin, such a non-receptive receiving material can also be used by forming a dye receptor layer on its one surface. On the other hand, in a case of the heat fusion transfer, the surface of the receiving material has no need of the receptiveness to the dye, and a normal paper, a plastic film or the like can be used with no receptor layer.

When the thermal transfer sheet of the present invention is subjected to the thermal transfer printing, any known thermal transfer printer is applicable.

According to the above-mentioned present invention, there can be provided a thermal transfer sheet which is excellent at response to a heated thermal head such as slipping property or releasability, capable of preventing formation of a head grime in a heating operation by the thermal head and a cooling process thereafter, and also preventing crumples of the thermal transfer sheet or an image-receiving material which is to caused in a printing process owing to estrangement of a friction coefficient between the printed portion to be heated and the non printed portion not to be heated, and further preventing contamination of the slip layer which is caused in a roll stock of the thermal transfer sheet owing to migration of the coloring material, thereby providing an image with high quality.

EXAMPLE

The present invention will be described hereunder more in detail by way of experiment examples, in which a term "part(s)" or "%" generally denotes weight part(s) or weight %, though not mentioned specifically.

Example 1

First, a coating liquid for a heat resistant layer A having the following composition was applied onto one surface of the substrate film of the polyethyleneterephthalate film having a thickness of 6 μm in an applied amount of about 1.0 g/m$^2$ (in dried state), and then dried. Second, a coating liquid for a slip layer A having the following composition was applied onto the heat resistant layer in an applied amount of about 0.1 g/m$^2$ (in dried state), and then dried. Then, a hardening treatment was carried out by heat aging to form the heat resistant layer and the slip layer. On the other hand, a coating liquid for a coloring material layer A having the following composition was applied onto another surface of the substrate film in an applied amount of about 1.0 g/m$^2$ (in dried state), and then dried to form the coloring material layer, thus forming the thermal transfer sheet of Example 1.

| <Coating Liquid for Heat Resistant Layer A> | |
|---|---|
| Polyvinyl butyral resin (ETHLEC BX-1, manufactured by Sekisui Kagaku Kogyo Co., Ltd.) | : 1.60 parts |
| Polyisocyanate (BARNOCK D-750-45, manufactured by Dainippon Ink Kagaku Kogyo Co. Ltd.) | : 8.46 parts |
| Surface active agent of phosphoric ester (PLYSURF A208S, manufactured by Daiichi Kogyo Seiyaku Co. Ltd.) | : 1.36 parts |
| Talc (MICRO ACE L-1, manufactured by Nihon Talc Co., Ltd.) | : 0.32 parts |
| Methyl ethyl ketone | : 38.43 parts |
| Toluene | : 38.43 parts |
| <Coating Liquid for Slip Layer A> | |
| Silylisocyanate represented by the formula (1) (ORGATIX SIC-434, manufactured by Matsumoto Kosyo Co. Ltd.) | : 10.0 parts |
| Methyl ethyl ketone | : 5.0 parts |
| Toluene | : 5.0 parts |
| <Coating Liquid for Coloring Material Layer A> | |
| MS-RED-G (DISPERSE RED 60, manufactured by Mitsuitoatsu Kagaku Co., Ltd.) | : 2.00 parts |
| Macrolex Red Violet R (DISPERSE VIOLET 26, manufactured by Bayer Co. Ltd.) | : 1.50 parts |
| Polyvinyl acetoacetal resin (ETHLEC KS-5, manufactured by Sekisui Kagaku Kogyo Co., Ltd.) | : 3.50 parts |
| Methyl ethyl ketone | : 46.50 parts |
| Toluene | : 46.50 parts |

Example 2

The thermal transfer sheet of Example 2 according to the present invention was obtained in the same manner as that in Example 1, except that the coating material for the heat resistant layer B having the following composition was used instead of the coating material for the heat resistant layer A.

| Coating Liquid for Heat Resistant Layer B | |
|---|---|
| Urethane Polyol (DF30-55, manufactured by Dainippon Ink Kagaku Kogyo Co. Ltd.) | : 1.60 parts |
| Polyisocyanate (BARNOCK D-750-45, manufactured by Dainippon Ink Kagaku Kogyo Co. Ltd.) | : 8.46 parts |
| Surface active agent of phosphoric ester (PLYSURF A208S, manufactured by Daiichi Kogyo Seiyaku Co. Ltd.) | : 1.36 parts |
| Talc (MICRO ACE L-1, manufactured by Nihon Talc Co., Ltd.) | : 0.32 parts |
| Methyl ethyl ketone | : 38.43 parts |
| Toluene | : 38.43 parts |

Example 3

The thermal transfer sheet of Example 3 according to the present invention was obtained in the same manner as that in Example 1, except that the coating material for the heat resistant layer C having the following composition was used instead of the coating material for the heat resistant layer A.

| Coating Liquid for Heat Resistant Layer C | |
|---|---|
| Polyester (VYLON 200, manufactured by Toyo boseki Co., Ltd.) | : 1.60 parts |
| Polyisocyanate (BARNOCK D-750-45, manufactured by Dainippon Ink Kagaku Kogyo Co. Ltd.) | : 8.46 parts |
| Surface active agent of phosphoric ester (PLYSURF A208S, manufactured by Daiichi Kogyo Seiyaku Co. Ltd.) | : 1.36 parts |
| Talc (MICRO ACE L-1, manufactured by Nihon Talc Co., Ltd.) | : 0.32 parts |
| Methyl ethyl ketone | : 38.43 parts |
| Toluene | : 38.43 parts |

Example 4

The thermal transfer sheet of Example 4 according to the present invention was obtained in the same manner as that in Example 1, except that the coating material for the heat resistant layer D having the following composition was used instead of the coating material for the heat resistant layer A.

| Coating Liquid for Heat Resistant Layer D | |
|---|---|
| Cellulose acetate (L20, manufactured by Hercules Co., Ltd.) | : 1.60 parts |
| Polyisocyanate (BARNOCK D-750-45, manufactured by Dainippon Ink Kagaku Kogyo Co. Ltd.) | : 4.23 parts |
| Surface active agent of phosphoric ester (PLYSURF A208S, manufactured by Daiichi Kogyo Seiyaku Co. Ltd.) | : 1.36 parts |
| Talc (MICRO ACE L-1, manufactured by Nihon Talc Co., Ltd.) | : 0.32 parts |
| Methyl ethyl ketone | : 38.43 parts |
| Toluene | : 38.43 parts |

Example 5

The thermal transfer sheet of Example 5 according to the present invention was obtained in the same manner as that in Example 1, except that the coating material for the heat resistant layer E having the following composition was used instead of the coating material for the heat resistant layer A.

| Coating Liquid for Heat Resistant Layer E | |
|---|---|
| Polyvinyl butyral resin (ETHLEC BX-1, manufactured by Sekisui Kagaku Kogyo Co., Ltd.) | : 1.60 parts |
| Polyisocyanate (BARNOCK D-750-45, manufactured by Dainippon Ink Kagaku Kogyo Co. Ltd.) | : 8.46 parts |
| Talc (MICRO ACE L-1, manufactured by Nihon Talc Co., Ltd.) | : 0.32 parts |
| Methyl ethyl ketone | : 38.43 parts |
| Toluene | : 38.43 parts |

Comparative Example 1

A coating liquid for a heat resistant layer A used in Example 1 was applied onto one surface of the substrate film of the polyethyleneterephthalate film having a thickness of 6 $\mu$m in an applied amount of about 1.0 g/m$^2$ (in dried state), an d then dried. Thereafter, a hardening treatment was carried out by heat aging to form the heat resistant layer. On the other hand, a coating liquid for a coloring material layer A used in Example 1 was applied onto another surface of the substrate film in an applied amount of about 1.0 g/m$^2$ (in dried state), and then dried to form the coloring material layer, thus forming the thermal transfer sheet of Comparative Example 1. The thermal transfer sheet of Comparative Example 1 is similar to that of Example 1, but has no slip layer.

Comparative Example 2

A coating liquid for a heat resistant layer B used in Example 2 was applied onto one surface of the substrate film of the polyethyleneterephthalate film having a thickness of 6 $\mu$m in an applied amount of about 1.0 g/m$^2$ (in dried state), and then dried. Thereafter, a hardening treatment was carried out by heat aging to form the heat resistant layer. On the other hand, a coating liquid for a coloring material layer A used in Example 1 was applied onto another surface of the substrate film in an applied amount of about 1.0 g/m$^2$ (in dried state), and then dried to form the coloring material layer, thus forming the thermal transfer sheet of Comparative Example 2. The thermal transfer sheet of Comparative Example 2 is similar to that of Example 2, but has no slip layer.

[Test And Results]

Each thermal transfer sheet obtained in the above mentioned Examples and Comparative Examples was laid on a conventionally used image receiving sheet so as to face a thermally transferable coloring material layer of the former to a receiving surface of the latter, and put between a thermal head and a platen roller. Further, 2000 kg of load was applied on the thermal transfer sheet by the thermal head, and the image receiving sheet was fixed.

Then, there was measured a frictional force F2 (gf) in the thermal transfer printing process which was caused by energizing the thermal head while drawing the thermal transfer sheet in a horizontal direction, namely, in a conveyance direction in the printing process being orthogonal to the above described load direction, at a constant speed of 500 mm/min by means of TENSIRON VCT-1000 (available from Orientec Co., Ltd.). There was also measured a frictional force F1 (gf) in no thermal transfer printing process which was caused by drawing the thermal transfer sheet in the same manner without energizing the thermal head. The thermal transfer printing process was carried out in the following condition.

| Printing Condition | |
|---|---|
| Applied voltage | : 13.5 V |
| Width of the pulse | : 22.5 ms |
| Cycle of the recording | : 11.25 ms/line |
| Recording energy | : 3.0 J/cm$^2$ |

After the measurement, coefficients of dynamic friction in no thermal transfer printing process ($\mu 1$) and in the thermal transfer printing process ($\mu 2$) were detected by putting the measured F1 or F2 in the following equation.

$$\mu = F/2000$$

The obtained $\mu 1$ and $\mu 2$ were shown in Table 1 together with the estrangement between them.

TABLE 1

| Number of Example | $\mu 1$ (Off Printing) | $\mu 2$ (On Printing) | $\mu 1$ - $\mu 2$ (Estrangement) |
|---|---|---|---|
| Example 1 | 0.16 | 0.17 | −0.01 |
| Example 2 | 0.16 | 0.14 | 0.02 |
| Example 3 | 0.17 | 0.14 | 0.03 |
| Example 4 | 0.15 | 0.16 | −0.01 |
| Example 5 | 0.16 | 0.19 | −0.03 |
| Comparative Example A-1 | 0.19 | 0.14 | 0.05 |
| Comparative Example A-2 | 0.20 | 0.14 | 0.06 |

What is claimed is:

1. A thermal transfer sheet comprising a substrate film, a transferable layer which is disposed on one surface of the substrate film, and a heat resistant layer and a slip layer both of which are disposed on another surface of the substrate film with said heat resistant layer and said slip layer being close to the substrate film in this order, wherein:

the heat resistant layer contains a binder resin having a molecular structure, one end portion of which is an end group selected from the group consisting of hydroxyl, amino, carboxyl and mercapto;

the slip layer contains silylisocyanate represented by the following formula (1):

$$R_n—Si—(NCO)_{4-n} \qquad \text{FORMULA (1)}$$

wherein in the formula (1), R denotes alkyl, aryl or vinyl; and "n" denotes an integer of 0 to 3; and wherein the slip layer is hardened by reacting an isocyanate group of the silylisocyanate contained in the slip layer with said end group of the binder resin contained in the heat resistant layer.

2. A thermal transfer sheet according to claim 1, wherein the heat resistant layer further contains a lubricant.

3. A thermal transfer sheet according to claim 2, wherein the lubricant is liquid state at a room temperature.

4. A thermal transfer sheet according to claim 1, wherein the heat resistant layer further contains an organic filler or an inorganic filler.

5. A thermal transfer sheet according to claim 4, wherein the heat resistant layer contains at least one inorganic filler selected from the group consisting of talc, kaolin and clay.

6. A thermal transfer sheet according to claim 1, wherein an applied amount of the heat resistant layer is not more than 5.0 g/m$^2$ in a solid component.

7. A thermal transfer sheet according to claim 1, wherein an applied amount of the slip layer is in a range of 0.1 to 1.0 g/m$^2$ in a solid component.

8. A thermal transfer sheet according to claim 1, wherein an applied amount of the heat resistant layer is not more than 5.0 g/m$^2$ in a solid component, and an applied amount of the slip layer is in a range of 0.1 to 1.0 g/m$^2$ in a solid component.

9. A thermal transfer sheet according to claim 1, wherein a primer layer is further disposed between the substrate sheet and the heat resistant layer.

10. A thermal transfer sheet according to claim 1, wherein the transferable layer is a coloring material layer selected from the group consisting of a sublimation dye layer and a heat fusible ink layer.

11. A method for manufacturing a thermal transfer sheet comprising a substrate film, a transferable layer disposed on one surface of the substrate film, and a heat resistant layer and a slip layer disposed on another surface of the substrate film respectively, which comprises steps of:

applying a coating material for the heat resistant layer containing a binder resin having a molecular structure, one end portion of which is an end group selected from the group consisting of hydroxyl, amino, carboxyl and mercapto on the substrate film, and solidifying same to form the heat resistant layer;

applying a coating material for the slip layer containing silylisocyanate represented by the following formula (1) on the heat resistant layer, $$R_n—Si—(NCO)_{4-n} \qquad \text{FORMULA (1)}$$

wherein in the formula (1), R denotes alkyl, aryl or vinyl; and "n" denotes an integer of 0 to 3 to form a raw slip layer; and, solidifying said raw slip layer while reacting an isocyanate group of the silylisocyanate contained in the raw slip layer with said end group of the binder resin contained in the heat resistant layer, to form the slip layer.

12. A method for manufacturing a thermal transfer sheet according to claim 11, wherein the coating material for the heat resistant layer is a coating liquid prepared by dissolving or dispersing the binder resin having a molecular structure, one end portion of which is an end group selected from the group consisting of hydroxyl, amino, carboxyl and mercapto in a solvent, and the solidifying step of the heat resistant layer is carried out by drying.

13. A method for manufacturing a thermal transfer sheet according to claim 11, wherein the coating material for the heat resistant layer is a coating liquid containing the binder resin having a molecular structure, one end portion of which is an end group selected from the group consisting of hydroxyl, amino, carboxyl and mercapto, and a hardening substance and the solidifying step of the heat resistant layer is carried out by hardening reaction of the hardening substance.

14. A method for manufacturing a thermal transfer sheet according to claim 11, wherein the coating material for the slip layer is a coating liquid prepared by dissolving or dispersing the silylisocyanate in a solvent, and the solidifying step of the slip layer is carried out by drying.

* * * * *